United States Patent [19]

Hamner et al.

[11] 4,094,168

[45] June 13, 1978

[54] ICE MAKING REFRIGERATION SYSTEM

[75] Inventors: George F. Hamner; Richard M. Hamner, both of Tuscaloosa, Ala.

[73] Assignee: Precision Fabricators, Inc., Albany, Ga.

[21] Appl. No.: 762,477

[22] Filed: Jan. 26, 1977

[51] Int. Cl.[2] ..... F25C 1/12

[52] U.S. Cl. ..... 62/347; 62/352; 62/503

[58] Field of Search ..... 62/503, 512, 347, 348, 62/352

[56] References Cited

U.S. PATENT DOCUMENTS

| | | | |
|---|---|---|---|
| 2,512,869 | 6/1950 | McBroom | 62/503 X |
| 2,807,150 | 9/1957 | Chapman | 62/503 X |
| 2,807,152 | 9/1957 | Chapman | 62/512 X |
| 3,034,310 | 5/1962 | Lowe | 62/352 X |
| 3,587,244 | 6/1971 | Wood, Jr. | 62/503 X |
| 3,721,104 | 3/1973 | Adler | 62/503 X |
| 3,837,173 | 9/1974 | Kuttruff et al. | 62/503 X |

*Primary Examiner*—William E. Wayner
*Assistant Examiner*—William E. Tapolcai, Jr.
*Attorney, Agent, or Firm*—Woodford R. Thompson, Jr.

[57] ABSTRACT

An ice making refrigeration system embodying an accumulator tank above and externally of a refrigerant chamber and communicating therewith by valved means for gravity flow of liquid refrigerant to the refrigerant chamber during a freezing phase. The upper portion of the accumulator tank communicates with the intake of a compressor to deliver vaporized refrigerant thereto. The upper portion of the refrigerant chamber communicates with the accumulator tank by a vapor-liquid return conduit. The discharge side of the compressor communicates with a condenser and the liquid side of the condenser communicates with the vapor-liquid return conduit downstream of the refrigerant chamber and delivers makeup liquid thereto in the general direction of flow of refrigerant therethrough. Valved means delivers hot gaseous refrigerant under pressure from the compressor to the refrigerant chamber during a harvesting phase.

5 Claims, 4 Drawing Figures

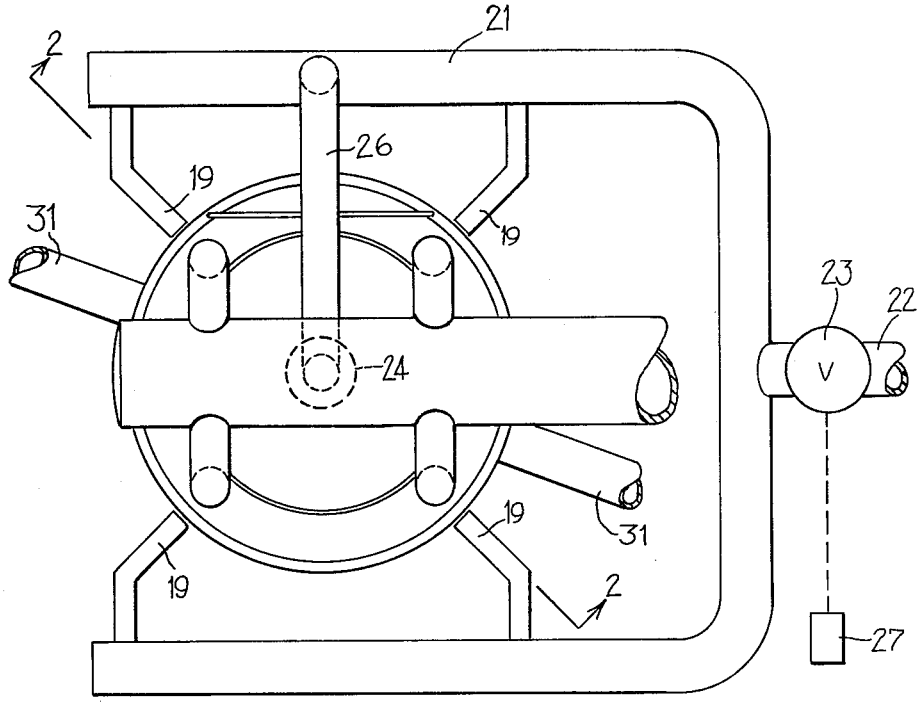
Fig 1
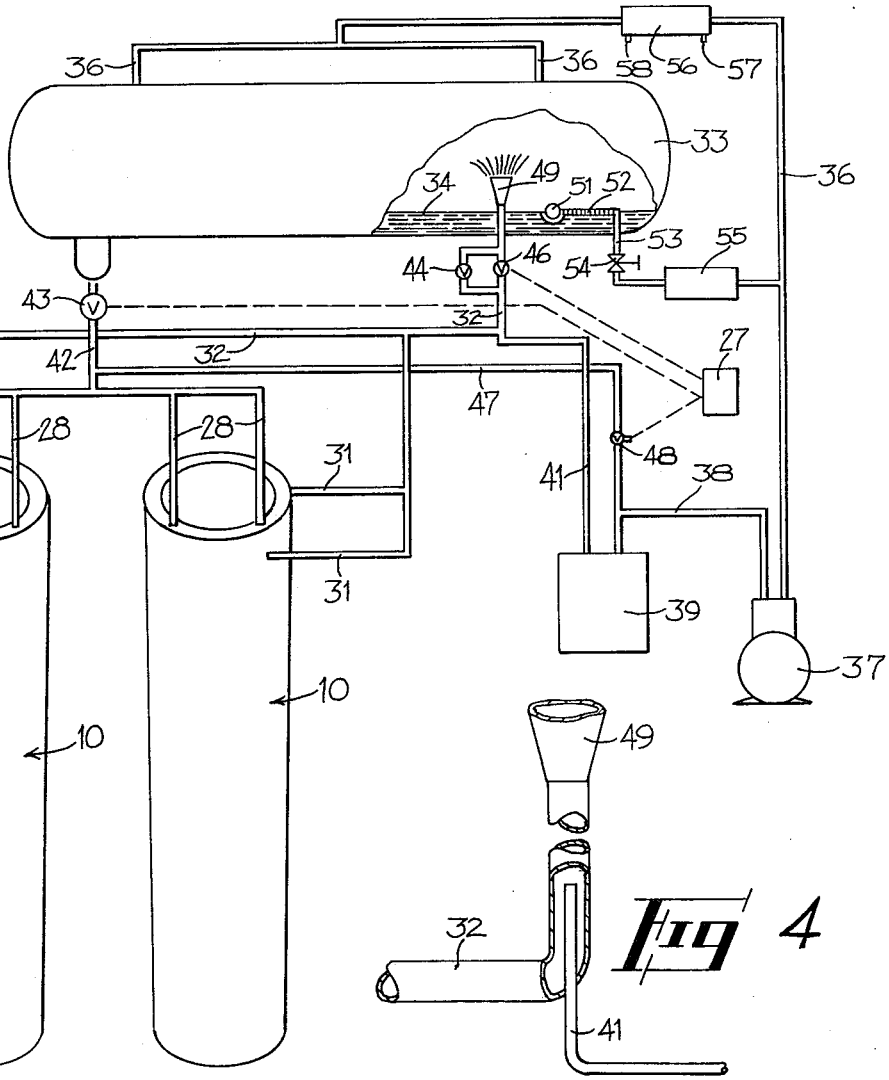
Fig 3
Fig 4

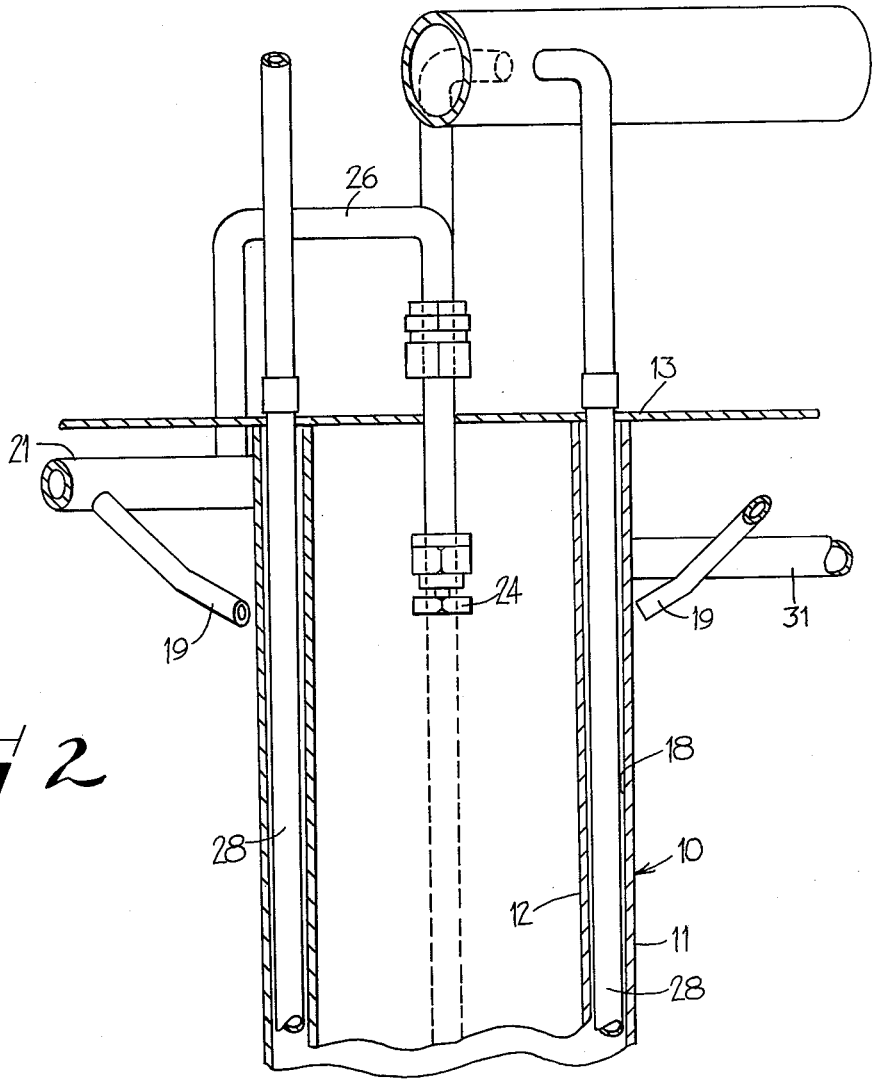
Fig 2
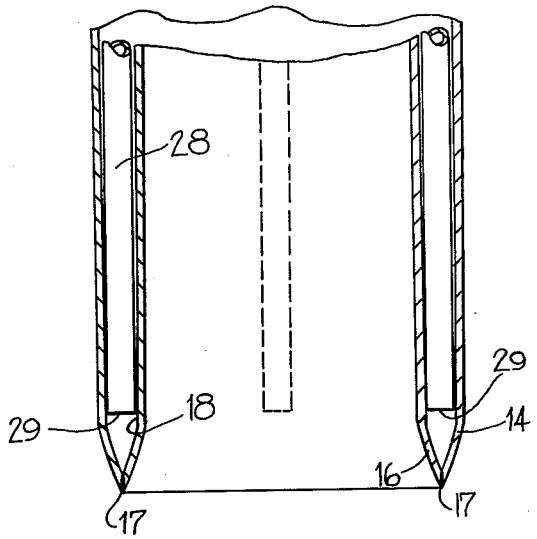

ICE MAKING REFRIGERATION SYSTEM

BACKGROUND OF THE INVENTION

This invention relates to an ice making refrigeration system which is adapted to be cycled alternately through a freezing phase and a harvesting phase and more particularly to improved means for cycling the refrigerant during the freezing and harvesting phases whereby the system is very efficient in operation.

As is well known in the art to which our invention relates, it is advantageous to supply refrigerant to the evaporator tubes in a 100% liquid state since liquid transfers heat much more readily than does vapor when in contact with a solid boundary. Accordingly, the system is much more efficient where more liquid is in contact with the walls of the evaporator tubes. This principle of full liquid refrigerant flooding in ice maker evaporators has long been the ideal solution for assuring maximum capacity in ice makers employing ammonia as a refrigerant. Liquid ammonia in this type application is usually furnished to the evaporators by liquid refrigerant pumps, an expensive and not trouble-free method, or by flooding the evaporator of the freezing chamber. Herretofore, the effective use of gravity flow of fluro-carbon, liquid refrigerant to the evaporator of an ice maker has been unobvious and unexpected due to the nature of the fluorocarbon refrigerant, its relative heavy weight, relatively low latent heat and associated compressor lubricating oil problems. While the Lowe U.S. Pat. Nos 3,026,686 and 3,034,310 disclose ice making machines having refrigerant receivers, such receivers are not adapted to supply liquid refrigerant to the evaporators by gravity flow. Our system is an improvement over that disclosed in these patents.

SUMMARY OF THE INVENTION

In accrodance with our invention, we overcome the above and other difficulties by providing a natural pump action in our refrigerant circulating system which pulls cold refrigerant through the freezing chamber at a rate sufficient to furnish several times the normal refrigerant evaporation rate. Accordingly, our system supplies a much greater percentage of liquid refrigerant to the evaporator tubes than systems heretofore employed. This is accomplished by forcing high pressure, refrigerant liquid from the condenser into the liquid-vapor return line downstream of the evaporator tubes. This high pressure, high temperature liquid exhausts into the liquid-vapor return line at a point downstream of the evaporator tubes. The high pressure, high temperature liquid thus defines a jet stream which is discharged into the liquid-vapor return line in the general direction of flow of refrigerant therethrough to form a mixture of the liquid delivered from the condenser and the vaporized refrigerant and liquid refrigerant delivered from the refrigerant chamber to thus aid in conveying the mixture through the vapor-liquid return conduit. The jet stream causes some of the liquid to flash, or boil away in order for this liquid to reach the lower temperature upon passing into the vapor-liquid return conduit. As the jet stream of liquid refrigerant passes into the vapor-liquid return conduit, its velocity becomes elevated causing a mechanical mixing of the surrounding fluids and at the same time forces it to move forward in the vapor-liquid conduit. The result of this pumping action is three-fold. First, the liquid refrigerant is pulled through its circuit into the evaporators by the partial vacuum created by the jet pumping action. Second, all flash gas, except that boiled away by the evaporation in the ice-making process, occurs outside the evaporator tubes, thereby maximizing the percentage of liquid in contact with the tube walls and maximizing the heat exchange rates. Third, the excess cold liquid moving through the evaporator results in higher velocities whereby the scrubbing action against the solid boundary and the heat exchange capability is greatly increased.

Another advantage of our improved system is that we provide a diffuser member at the outlet of the vapor-liquid return conduit within the accumulator. This diffuser reduces the velocity of the refrigerant liquid vapor mixture prior to its movement into the accumulator, thus recovering the kinetic energy which would otherwise be lost.

DESCRIPTION OF THE DRAWINGS

A refrigerating system embodying features of our invention is illustrated in the accompanying drawings, forming a part of this application, in which:

FIG. 1 is a top plan view, partly broken away;

FIG. 2 is a vertical sectional view taken generally along the line 2—2 of FIG. 1;

FIG. 3 is diagrammatic view showing our improved system; and,

FIG. 4 is an enlarged, fragmental view showing apparatus which produces our improved jet type action within the vapor-liquid return conduit downstream of the evaporators.

DETAILED DESCRIPTION

Referring now to the drawings for a better understanding of our invention, we show upstanding evaporator units 10. Each evaporator unit 10 is shown as comprising an outer tubular member 11 and an inner tubular member 12. The upper ends of the tubular members 11 and 12 are connected to each other by a suitable closure means, such as a horizontal plate 13 which seals the space between the upper ends of the tubular members 11 and 12.

The lower ends of the tubular members 11 and 12 are closed by suitable means, such as by tapering the lower end of the outer tubular member 11 inwardly as at 14 and by flaring the lower end of the inner tubular member 12 outwardly as at 16. The adjacent lower ends of the tubular members 11 and 12 are secured to each other by suitable means, such as by welding at 17. The closed space between the outer tubular member 11 and the inner tubular member 12 defines a closed refrigerant chamber 18 having exposed outer and inner freezing surfaces.

Water or other substances to be frozen on the external freezing surfaces of the tubular member 11 is supplied by angularly spaced spray nozzles 19 which communicate with water supply conduit 21 which in turn communicates with a water supply conduit 22 having a control valve 23 therein, as shown in FIG. 1. Water or other substance to be frozen on the interior surface of the inner tubular member 12 is supplied by a spray head 24 carried by a conduit 26 which communicates with the water supply conduit 21, as shown. Suitable control means, such as a timer device 27, is employed for introducing the water or other substance to be frozen on the exterior and interior freezing surfaces of the tubular members 11 and 12 at the beginning of the freezing phase and to interrupt the flow of water or other substance at the end of the freezing phase. That is, the timer device 27 is operatively connected to the control valve 23 provided in the main supply conduit 22, as shown in FIG. 1.

Liquid refrigerant is supplied by gravity to the refrigerant chamber 18 of the evaporator 10 by refrigerant lines 28 having their lower ends 29 terminating adjacent the bottom of the refrigerant chamber 18, as shown in FIG. 2. The expanding refrigerant gas is thus adapted to move upwardly between the tubular members 11 and 12 where it is removed along with some liquid refrigerant by vapor-liquid return conduits 31 which in turn communicate with a vapor-liquid return conduit 32 that delivers the mixture of vapor and liquid refrigerant to an accumulator tank 33. The liquid refrigerant, indicated at 34, is collected in the accumulator tank 33 while the refrigerant vapors are discharged through one or more discharge conduits 36 which convey the vaporized refrigerant to a compressor 37.

A conduit 38 connects the discharge side of the compressor 37 with a condenser 39. A conduit 41 communicates the liquid side of the condenser 39 with the vapor-return line 32 whereby high pressure makeup liquid refrigerant is delivered into line 32 to thus form a mixture of the liquid delivered from the condenser 39 and the vapor-liquid refrigerant mix delivered from the refrigerant chamber 18 and also to aid in movement of the liquid-vapor mixture to the accumulator tank 33. As shown in FIG. 3, the liquid refrigerant is transferred from the accumulator tank 33 to the refrigerant supply lines 28 through a conduit 42 having a control valve 43 therein. Also, the vapor-liquid return conduit 32 is provided with a by-pass regulator valve 44 and a control valve 46 therein downstream of the point that the conduit 32 communicates with the conduit 41 that delivers refrigerant liquid from the condenser 39.

Communicating with the conduit 42 downstream of the control valve 43 is a hot gas line 47 having a control valve 48 therein. Line 47 communicates with the line 38 that receives hot gaseous refrigerant under pressure from the discharge side of compressor 37. The timer device 27 is operatively connected to the valves 43, 46 and 48 whereby the valves 43 and 46 are closed and the valve 48 is opened at the beginning of the harvesting phase so that hot gaseous refrigerant is supplied under pressure to the refrigerant chamber 18 through lines 42 and 28 to warm the ice-forming surfaces and displace refrigerant from chamber 18 whereby it is transferred to the accumulator tank 33. This speeds up the release of ice formed on the ice forming surfaces of the evaporators for gravitational delivery to a suitable ice crushing or storage container, not shown.

As shown in FIG. 4, the discharge end of the container 41, which delivers high pressure makeup liquid refrigerant that replaces the liquid evaporated in the refrigeration process, extends into the vapor-liquid return conduit 32 in the general direction of flow of refrigerant therethrough. A jet pump action is thus produced which forms a mixture of the liquid delivered from the condenser and the vaporized refrigerant and liquid refrigerant delivered from the evaporator. Also, the jet pump action created within the vapor-liquid return conduit adjacent the discharge end of the conduit 41 aids in conveying the mixture toward the accumulator tank 33 whereby a suction is created within the conduit 32 to aid in drawing the refrigerant through the evaporators 10. Accordingly, during the ice making phase of a cycle of operation of the system, cold liquid is fed to the evaporators by gravity through conduits 42 and 28 and at the same time the jet pump action created within the conduit 32 adjacent the end of the conduit 41 aids in drawing the refrigerant from the evaporators. Also, as shown in FIG. 4, an upwardly flaring diffuser member 49 is provided at the discharge end of the vapor-liquid return conduit 32 within the accumulator tank 33 to reduce the pressure of refrigerant in the vapor-liquid return conduit before the refrigerant passes from the diffuser member 49 into the accumulator tank 33, thereby reducing loss by kinetic energy.

The by-pass regulator valve 44 by-passes liquid around the conrol valve 46 during the harvesting phase to maintain a predetermined pressure in the vapor-liquid return conduit and at the same time allow condensed liquid to pass from the evaporators to the accumulator tank 33.

To remove oil continuously from the surface of the liquid 34 in the accumulator tank 33, we mount a float 51 adjacent the free end of a flexible tube 52 whereby the open end of the tube 52 extends into the upper layer of the oil-refrigerant mixture. The flexible conduit 52 communicates with a conduit 53 having a needle valve 54 therein which is located outwardly of the accumulator tank 33. The conduit 53 communicates with conduit 36 and is provided with a conventional heater unit 55 therein for evaporating any liquid refrigerant whereby evaporated refrigerant moves upwardly in line 36 and is returned to the accumulator tank 33. Accordingly, only oil is delivered to the intake side of the compressor 37. The flexible tube 52 thus is caused to float by the float 51 whereby the intake end of the tube continuously siphons oil-refrigerant mix off the top of the refrigerant in the accumulator tank 33 regardless of the level of refrigerant therein. This is important since in fluorocarbon systems the oil is at the top of the liquid refrigerant. The oil-refrigerant mix then passes through conduit 53 and needle vavle 54 through the heater unit 55 to the conduit 36. A heat exchanger unit 56 may be provided in the upper portion of the conduit 36 whereby warm liquid from the condenser, or conduit 41, could be introduced through an inlet conduit 57 and discharged through conduit 58 to warm the vapors passing through the upper portion of conduit 36 whereby the suction gas may be superheated for move efficient compressor operation. The cooling liquid from conduit 58 may then be directed to the conduit 41.

From the foregoing description, the operation of our improved ice making refrigeration system will be readily understood. At the start of the freezing phases, the timer 27 opens the valves 43 and 46 whereby liquid refrigerant flows by gravity from the accumulator tank 33 through conduits 42 and 28 into the lower portion of the refrigerant chamber 18 of each evaporator 10. The refrigerant then flows upwardly in the refrigerant chamber 18 whereupon it is discharged through conduits 31 and passes through vapor-liquid return conduit 32 to the accumulator tank 33. The gaseous refrigerant is discharged from the upper portion of the accumulator tank 33 and is conveyed by conduit 36 to the intake side of the compressor 37. The compressed refrigerant is conveyed through conduit 38 to the condenser 39 whereupon liquid refrigerant is then transferred to line 41 into the liquid-vapor line 32 where it aids in transferring the liquid-vapor mixture into the accumulator tank 33. That is, the jet-pump action described hereinabove adjacent the discharge end of conduit 41 forces the mixture toward the accumulator tank 33 and creates a negative pressure in the line 32 between the discharge end of conduit 41 and the evaporator 10 whereby refrigerant is pulled through lines 32 and 31 as liquid refrigerant flows by gravity through the conduits 42 and 28.

At the beginning of the freezing phase, the timer device 27 also opens valve 23 whereby water or other substance to be frozen is discharged through nozzles 29 and the spray head 24 onto the freezing surfaces of the evaporators 10. The water applied to the freezing surfaces provides the heat to boil the refrigerant within the refrigeration chamber 18. The evaporation of the refrigerant in the refrigeration chamber 18 in addition to the brine effect of the increased circulation of cold refrigerant provides the cold side of the effuent heat exchange cycle. When the ice has reached a predetermined thickness, which is controlled by the timer device 27, the valves 43 and 46 are closed and valve 48 is opened to allow hot refrigerant discharge gas to enter the evaporators 10 from the compressor 37. Excess pressure and liquid is relieved through by-pass regulator valve 44. That is, regulator valve 44 maintains a predetermined pressure during the harvest phase and also allows condensed liquid to flow from the refrigerant chamber 18 during the harvest phase.

As the hot gaseous refrigerant moves upwardly in the refrigerant chamber 18, it forces the liquid-vapor mixture through conduits 31 and 32 to the accumulator tank 33. During the harvesting phase, the hot refrigerant gas warms the freezing surfaces on the tubular members 11 and 12 whereby adjacent surfaces of the tubes of ice formed thereon are warmed sufficiently for the tubes of ice to move downwardly relative to their adjacent freezing surfaces. The ice then passes to a suitable crusher or storage bin. In view of the fact that such ice crushers and storage bins are well known in the art to which our invention relates, no further description thereof is deemed necessary.

From the foregoing, it will be seen that we have devised an improved system for making ice. By providing means for circulating the refrigerant through the system which embodies both gravity and a pumping action, liquid refrigerant is supplied to the evaporators by gravity and at the same time refrigerant is exhausted therefrom due to the suction created by our jet pump system. Also, all flash gas, except that boiled away by the evaporation in the ice making process inside the evaporator, occurs outside the tubes, thus maximizing the percentage of liquid in contact with the walls of the refrigerant chamber, thereby maximizing the heat exchange rates. Also, the increased flow of liquid moving through the evaporators results in high velocities whereby a scrubbing action is obtained against the solid boundary, thus greatly increasing the heat exchange capability of our system. Furthermore, the provision of a conical or upwardly flaring diffuser at the outlet of the vapor-liquid return conduit to the accumulator tank 33 reduces the velocity of the refrigerant liquid-vapor mixture, thus recovering the kinetic energy which would otherwise be lost. Furthermore, by maximizing the percentage of liquid in contact with the walls of the evaporator by using the natural processes of our improved system, we greatly increase the efficiency of our system and produce more refrigerating effect per unit of power employed.

While we have shown our invention in but one form, it will be obvious to those skilled in the art that it is not so limited, but is susceptible of various changes and modifications without departing from the spirit thereof.

What we claim is:

1. In an ice making refrigerating system adapted to be cycled alternately through a freezing phase and an ice harvesting phase and including a compressor, a condenser and an evaporator having a closed refrigerant chamber with an ice forming surface thereon for applying a substance to be frozen during the freezing phase, (a) an accumulator tank above and externally of said refrigerant chamber, (b) valve means communicating said accumulator tank with said refrigerant chamber and disposed to deliver liquid refrigerant by gravity flow to said refrigerant chamber during the freezing phase, (c) a suction conduit communicating the upper portion of said accumulator tank with the suction side of said compressor for separating liquid from vapor and returning vaporized refrigerant to said compressor, (d) a vapor-liquid return conduit communicating an upper portion of said refrigerant chamber with said accumulator tank and disposed to convey vaporized refrigerant and liquid refrigerant from said refrigerant chamber to said accumulator tank, (e) conduit means communicating the discharge side of said compressor with said condenser, (f) conduit means communicating the liquid side of said condenser with said vapor-liquid return conduit downstream of said refrigerant chamber so that high pressure makeup liquid replaces the liquid evaporated in the referigeration process and is delivered from the condenser to said vapor-liquid return conduit in the general direction of flow of refrigerant therethrough to form a mixture of said liquid delivered from the condenser and said vaporized refrigerant and liquid refrigerant delivered from said refrigerant chamber and to aid in conveying said mixture toward said accumulator tank, (g) valved means for conveying hot gaseous refrigerant under pressure from the discharge side of said compressor to said refrigerant chamber during the harvesting phase to warm said ice forming surface and displace refrigerant from said refrigerant chamber to said accumulator tank; and (h) control means in said vapor-liquid return conduit downstream of the point said conduit means communicates the liquid side of said condenser with said vapor-liquid return conduit for restricting flow through said vapor-liquid return conduit during the harvesting phase to maintain a predetermined pressure in said vapor-liquid return conduit and allow liquid to pass from said refrigerant chamber to said accumulator tank when a predetermined pressure is reached in said vapor-liquid return conduit.

2. An ice making refrigerating system as defined in claim 1 in which said conduit means communicating the liquid side of said condenser with said vapor-liquid return conduit includes a jet-like member at its discharge end extending inwardly of a portion of said vapor-like return conduit which is configured to receive said jet-like member and define therewith a jet pump.

3. An ice making refrigerating system as defined in claim 1 in which said control means is a control valve and a by-pass regulator valve is provided in said vapor-liquid return conduit in position to by-pass refrigerant by said control valve during the harvesting phase to maintain said predetermined pressure in said vapor-liquid return conduit and allow liquid to pass from said refrigerant chamber to said accumulator tank when said pedetermined pressure is reached.

4. An ice making refrigerating system as defined in claim 1 in which a diffuser member is carried by the discharge end of said vapor-liquid return conduit within said accumulator tank to reduce the pressure of refrigerant in said vapor-liquid return conduit before the refrigerant passes from the diffuser into said accumulator tank thereby reducing loss of kinetic energy.

5. An ice making refrigerating system as defined in claim 1 in which oil-rich refrigerant is removed from the accumulator tank by means comprising:

(a) a movable tube extending within said accumulator tank and having a free end adapted for movement to any normal elevation assumed by the liquid refrigerant within said accumulator tank, (b) float means supporting said free end of said movable tube at an elevation to receive oil-rich refrigerant mixture from the upper portion of the liquid in said accumulator tank, (c) an oil removal conduit communicating at its receiving end with said movable tube and extending outwardly of said accumulator tank and having a regulator valve therein with the discharge end of said oil removal tube communicating with said suction conduit, and (d) a heat exchanger disposed to heat the mixture passing through said oil removal conduit to a temperature to evaporate any liquid refrigerant passing therethrough so that oil is the only liquid conveyed to said compressor.

* * * * *